United States Patent [19]

Cusey et al.

[11] Patent Number: 4,591,868

[45] Date of Patent: May 27, 1986

[54] COLLAPSIBLE MOTOR OPERATED ANTENNA

[75] Inventors: Dar L. Cusey; Roy A. Kitchens, both of Montgomery, Ala.

[73] Assignee: National Industries, Inc., Montgomery, Ala.

[21] Appl. No.: 751,017

[22] Filed: Jul. 2, 1985

Related U.S. Application Data

[63] Continuation-in-part of Ser. No. 563,402, Dec. 7, 1983, abandoned, which is a continuation-in-part of Ser. No. 366,918, Apr. 9, 1982, abandoned.

[51] Int. Cl.[4] ..... H01Q 1/10

[52] U.S. Cl. ..... 343/903; 318/467

[58] Field of Search ..... 343/901, 903; 318/467, 318/626

[56] References Cited

U.S. PATENT DOCUMENTS

| | | | |
|---|---|---|---|
| 3,582,739 | 6/1971 | Daab et al. | 318/467 |
| 3,757,232 | 9/1973 | Matsuda | 318/467 |
| 4,209,792 | 6/1980 | Carolus et al. | 343/903 |

FOREIGN PATENT DOCUMENTS

| | | | |
|---|---|---|---|
| 2050098 | 7/1971 | Fed. Rep. of Germany | 343/903 |
| 2061640 | 9/1972 | Fed. Rep. of Germany | 343/903 |
| 2313447 | 9/1974 | Fed. Rep. of Germany | 343/903 |
| 2640995 | 3/1978 | Fed. Rep. of Germany | 343/903 |
| 2277445 | 1/1976 | France | 343/903 |
| 1435493 | 5/1976 | United Kingdom | 343/903 |

*Primary Examiner*—Eli Lieberman

*Attorney, Agent, or Firm*—Watts, Hoffmann, Fisher & Heinke

[57] ABSTRACT

A retractable motor-driven antenna 10 of compact size and light weight capable of being supported at the top of a support tube 14. A molded plastic housing 12, 30 in part forms the drive motor. A drive transmission 34 for extending and retracting the antenna mast 15 uses a timing belt 78 and pulley wheels 61, 62 and includes an overrunning clutch 84 or energy storage and release interconnection 76 between a drive pulley wheel 261 and a motor output shaft that drives a flexible cord 46 connected to the antenna mast. A switch assembly within the housing includes automatically stops the drive when the mast reaches its extended or retracted position or is obstructed. A coupling between the molded plastic housing and an antenna support tube isolates the housing from road vibration.

23 Claims, 16 Drawing Figures

COLLAPSIBLE MOTOR OPERATED ANTENNA

CROSS REFERENCE TO RELATED APPLICATION

This application is a continuation-in-part of U.S. application Ser. No. 563,402, filed Dec. 7, 1983, entitled "Collapsible Motor-operated Antenna" which is a continuation-in-part of U.S. application Ser. No. 366,918, filed April 9, 1982, entitled "Collapsible Motor-operated Antenna", both abandoned.

TECHNICAL FIELD

This invention relates to a collapsible, motor-operated, (so-called "electric") antenna, especially for automotive use.

BACKGROUND ART

Collapsible antennas raised and lowered by electric motors are widely used on automobiles. Such antennas are typically mounted in a fender well. The power and strength required for the drive mechanism has, in the past, required a relatively bulky and heavy antenna and motor assembly, requiring substantial space and a relatively strong mounting bracket within the fender well. With the present popularity of smaller and lighter automobiles, the available space for automotive accessories is at a premium. The space used by one accessory takes from that available for another. In addition, the weight of an automobile has a substantial effect upon its gasoline mileage and substantial effort is being made to reduce the total weight of automobiles. Accordingly, the need for compact and lightweight accessories, including motor-operated antennas, is especially great. Nevertheless, a motor-operated antenna must be rugged and powerful enough to function under the adverse conditions of vibration, snow, ice, and the like, and be low in cost and reliable in its operation.

DISCLOSURE OF INVENTION

The present invention overcomes the size and weight disadvantages of known motor-operated antennas by providing a small, light-weight, rugged, motor-operated, collapsible antenna that is relatively low in cost. The antenna is small enough and light enough to be mounted with a minimum of bracketing. It is of a size that permits it to be mounted in a space 3 inches by 1½ inches by 13 inches. In a preferred embodiment, the antenna weighs approximately one pound and can be satisfactorly mounted with top hardware only. This eliminates a redundant ground connection and support.

The disclosed motor driven antenna includes a supporting tube and a number of telescoping antenna sections collapsible within the tube. A reversible electric motor extends and retracts the antenna sections via a transmission having a rotatably supported nut that engages threaded portions of a flexible cord connected at one end to one of the antenna sections.

A compact, light-weight, drive transmission is provided by two pulley wheels and a belt that establish a substantial speed reduction and hence allow use of a relatively small DC reversible electric motor to supply the necessary power to raise and lower the antenna sections. One pulley wheel drives the rotary nut, which is journalled in the housing. The nut drives the threaded cord connected to the antenna sections and extending through the housing. An interconnection is provided for absorbing, storing and releasing rotary energy. The interconnection preferably incorporates an overrunning slip clutch. The arrangement serves as a progressive braking means at the end of antenna travel and then, after decelerating the rotating members to a stationary condition, unwinds to relieve forces on the system elements. The arrangement also allows the drive motor to continue running a short time after antenna movement stops, without overloading the motor. This provides for a "soft start" in either direction, requiring less starting torque from the motor.

Motor energization and direction of rotation is controlled by a relay activated by a radio on/off switch. The motor is de-energized by a limit switch that responds to antenna movement and senses when the rotary nut has driven the antenna to a limit of travel. When a travel limit is reached, the switch senses movement of a flange coupled to the drive nut and deenergizes the motor. In this preferred embodiment a spring biased thrust bearing allows a driven pulley to move up and down within the bearing when a travel limit is reached.

In an alternate embodiment, the motor is deenergized by a transducer mounted in close proximity to the nut that drives the antenna sections. The transducer senses rotation of the nut and once rotation stops, indicating the antenna is either fully retracted or extended, the transducer disrupts power to the motor.

The preferred transducer is a Hall-effect transducer which generates a series or sequence of pulses as the nut rotates. These pulses maintain a bipolar switch coupled to the motor in a conductive state. When the pulses stop the switch is rendered nonconductive and power to the motor is disrupted. The motor is disabled regardless of the reason rotation stops so that if, for example, the antenna cannot be extended or retracted to its full extent, the motor is not overloaded.

An improved housing is provided to in part comprise the drive motor, and to enclose a motor switch and drive transmission, and to connect with one end of a supporting tube that receives the telescoping antenna sections. The motor is supported beside the supporting tube, with its shaft parallel to the tube. In the preferred embodiment, the housing is a multiple piece housing of molded plastic. Two of the pieces form a cavity to house the drive transmission and switch, and provide a through passage centrally of a boss that connects with the antenna sections and supporting tube. A threaded drive cord that extends and retracts the antenna sections passes through the passage. A third piece of the housing extends beside the boss and supporting tube from the chamber formed by the other two pieces, and houses the motor armature. The two pieces of the housing forming the chamber are of the same width as the third housing piece and the construction provides a very narrow assembly.

A flexible coupling between the housing and the antenna support tube isolate the housing from road vibration. A tubular neoprene rubber connector is coupled to a housing boss at one end and to the support tube at an oposite end so that vibrations are absorbed by the connector before they reach the plastic housing.

The above and other features and advantages of the invention will become more apparent from the detailed description that follows, when considered in connection with the accompanied drawings.

BEST MODE FOR CARRYING OUT THE INVENTION

Figure 1:
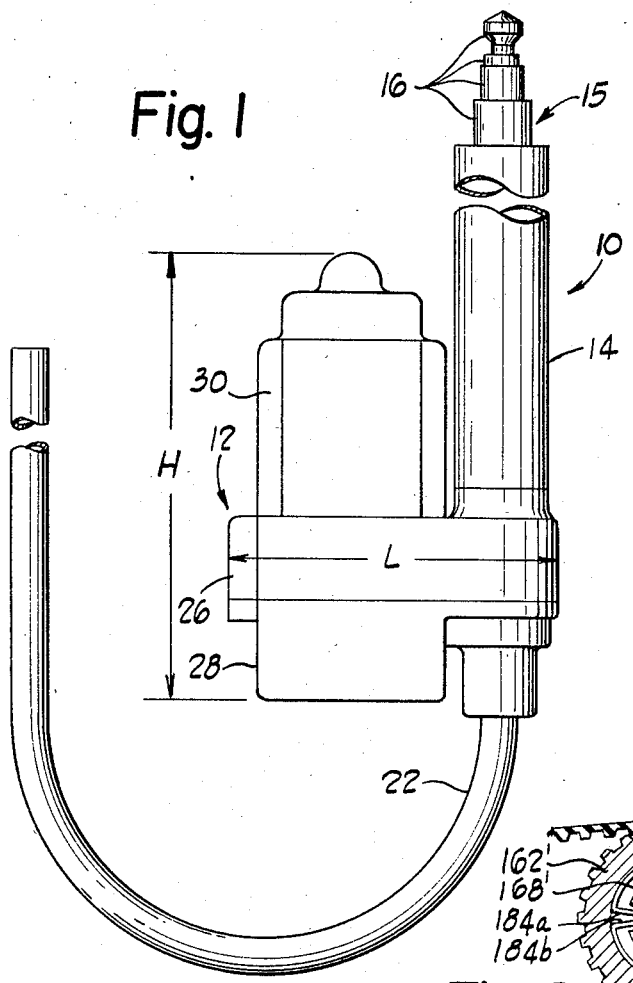
FIG. 1 is a side elevational view of an antenna assembly embodying the present invention.
Figure 2:
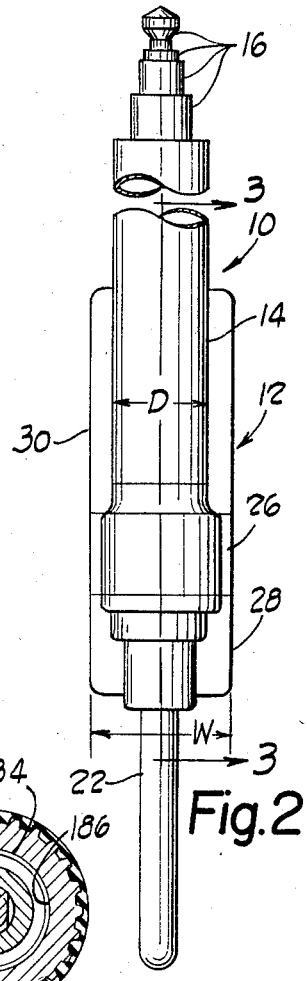
FIG. 2 is an end elevational view of the antenna of FIG. 1.
Figure 12:
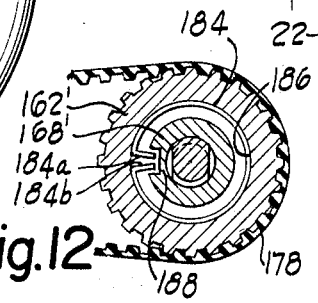
FIG. 12 is a sectional view taken along the line 12—12 of FIG. 10.
Figure 3:
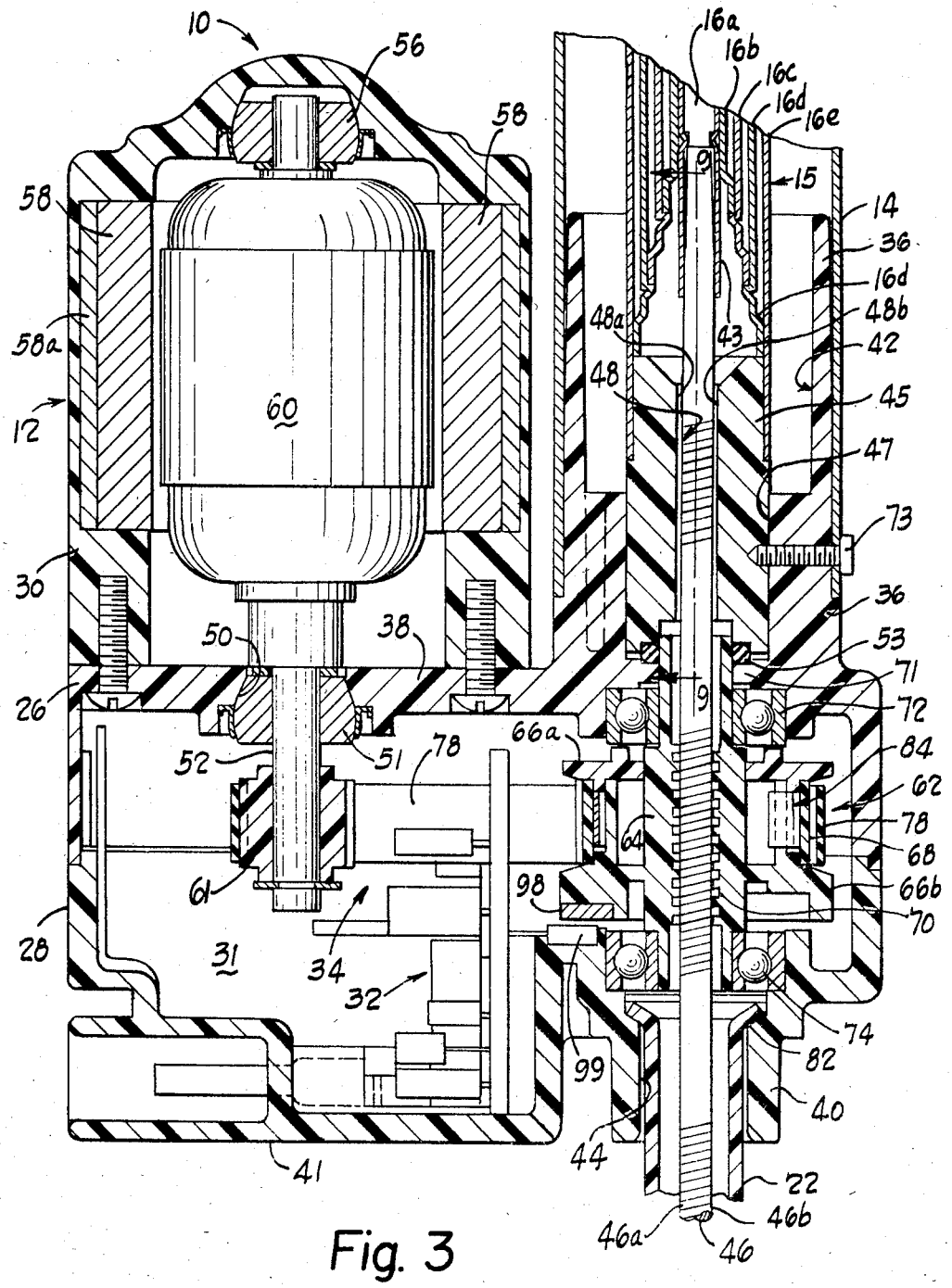
FIG. 3 is a partial sectional view of the antenna of FIGS. 1 and 2, taken along the line 3—3.

An antenna assembly 10 embodying the invention is shown in FIGS. 1-3, comprising a housing 12 for a motor and drive transmission, a supporting tube 14 for supporting the assembly and for housing a collapsible antenna mast 15 comprised of telescoping sections 16, and a flexible sotrage tube 22 for a flexible cord that extends and retracts the telescoping sections 16*a-d*. As FIGS. 1 and 2 show, the housing 12 is elongated and very little wider than the supporting tube 14. The assembly is very compact and can be mounted within a small space.

As best shown in FIG. 3, the housing 12 is formed of three injection molded plastic pieces 26, 28, 30, that interfit to form a strong enclosure. Pieces 26, 28 together form a cavity 31 for a printed circuit board and switch assembly 32 and a drive transmission 34. The housing piece 26 has a cylindrical boss 36 projecting perpendicularly from a top wall 38 to connect with the supporting tube 14. The housing piece 28 has a cylindrical boss 40 extending perpendicular to a bottom wall 41, aligned with the boss 36, and accommodating connection of the flexible storage tube 22 with the housing.

A central opening 42 extends through the boss 36 and a central opening 44 extends through the boss 40, each axially aligned with the other, to accommodate passage of a flexible cord 46 through the housing. Beyond the boss 36, the cord is connected to a center antenna section 16*a* by a coupling tube 43 which is crimped about the cord 46 and center section 16*a*. Beyond the boss 40, the cord 46 extends into the storage tube 22.

The cord is of plastic, such as Delrin, and is externally threaded on two diametrically opposite portions. The cord has two diametrically opposite flat outer surfaces 46*a*, 46*b* along its length, resulting in peripherally broken threads. The cord passes through a central opening 48 of a tubular plastic insulator 45 within the boss 36, the insulator being cylindrical and slidably received within a cylindrical wall 47 within the boss 36. The insulator is partially received within the base of the fixed tube 16*e* and the two are secured together, as by crimping or otherwise, deforming a part of the tube into the insulator. Two opposed flat surfaces 48*a*, 48*b* of the plastic insulator prevent rotation of the cord 46 relative to the housing, yet provide sufficient clearance to allow free sliding of the cord. Because the inside passage 48 is subject to wear from the movement of the cord 46 it is made long relative to its diameter (several times as long) and is replaceable within the housing.

To avoid risk of malfunctioning of the antenna drive from exposure to water that may find its way into the housing along or near the antenna mast, and which in cold weather can freeze and prevent relative movement between parts of the tubular drive transmission, two passages 49 (FIG. 9) are provided in the boss 36. The passages open at one end 49*a* in communication with drains 45*a*, 45*b* in the tubular insulator 45 and at the other end 49*b* at the exterior of the housing below the supporting tube 14, and are inclined downwardly and outwardly. The drains 45*a*, 45*b* are located above an O-ring seal 53 at the base of the insulator 45, between the insulator and the housing wall 38. Water leaking along the antenna 15 mast is intercepted before reaching the seal 53 and carried away through the less restrictive drains 45*a*, 45*b* and passages 49 to the outside of the housing. Also, water that may find its way between the telescoping antenna sections will tend to be flung from the cord 46 as it is rotated and will be received by the drains 45*a*, 45*b*. The seal 53 blocks the flow of any water that might happen to seep past the drains 45*a*, 45*b*.

Figure 6A:
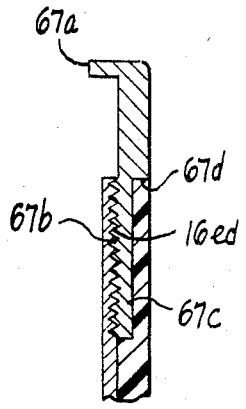
FIG. 6A is an enlarged sectional view showing details of a retaining collar which can be removed to allow a replaceable antenna unit to be replaced.
Figure 6:
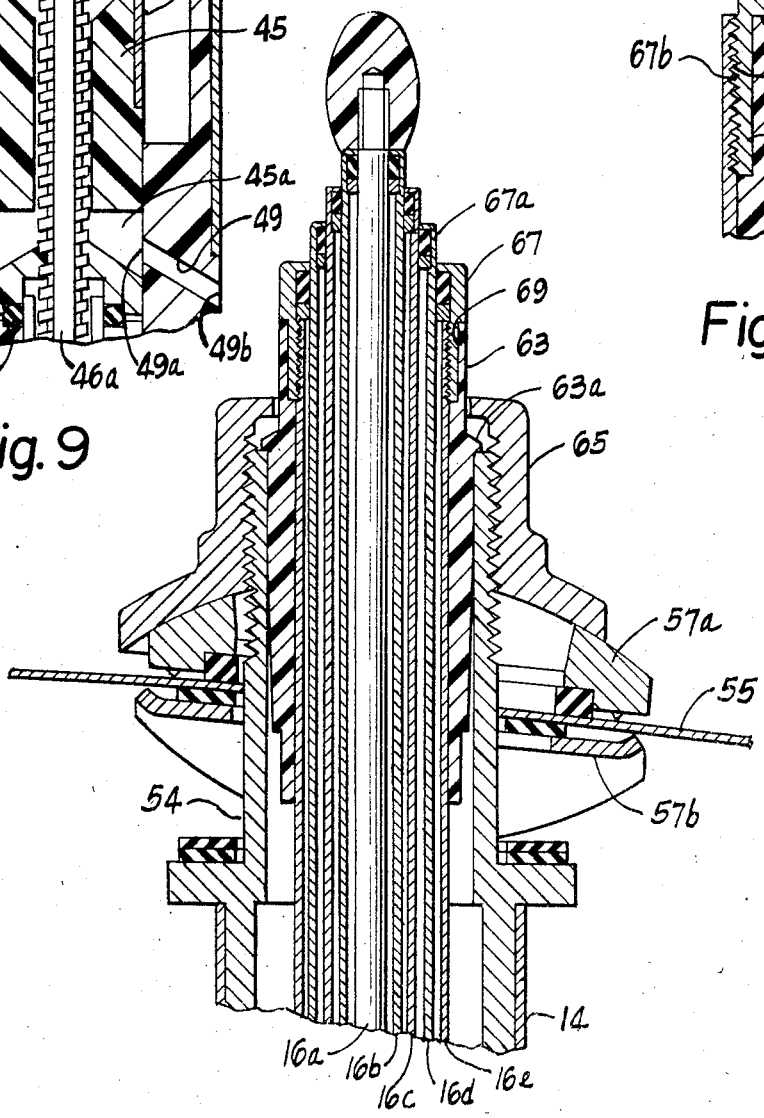
FIG. 6 is a partial sectional view of the antenna of FIGS. 1 and 2 showing the antenna supported by a mounting surface.

An upper end of the support tube 14 is securely fastened by brazing or welding to a metal mounting member 54, which extends through an opening in a mounting sheet 55 such as an automobile fender or the like (FIG. 6). Top 57*a* and bottom 57*b* mounting brackets orient the antenna sections 16*a-e* at any desired angle with respect to the sheet 55 so that the antenna rises in the desired direction when it is extended.

A tubular plastic insulator 63 fits closely around the upper end of the outer fixed antenna tube 16*d* and includes a circular external shoulder 63*a*, which rests against an upper end of the mounting member 54. With the insulator 63 in place, a retaining nut 65 having an inner threaded portion is tightened down over an outer threaded portion of the mounting member 54 until the brackets 57*a*, 57*b* and mounting member 54 are securely mounted to the sheet 55.

The antenna sections 16*a-d* are replaceable so that if any are broken or bent an entire unit of those sections 16*a-d* may be removed and replaced. The outer section 16*d* is retained within the fixed antenna tube 16*e* by a retaining collar 67 that has a central opening 67*a* closely surrounding the section 16*d* which is too small to allow the enlarged base portion 16*d* (FIG. 3) to pass through. The collar 67 has an internal thread 67*b* that engages a threaded exterior portion 16*ea* at the extending end of the fixed antenna tube 16*e*. When the collar 67 is securely fastened to the outer tube 16*e*, a reduced diameter portion 67*c* telescopes into a cylindrical recess 69 formed between the end of the outer tube 16*e* and the insulator 63. A circumferential flange 67*d* abuts the end of the insulator 63.

The housing piece 26 (FIG. 3) has an opening 50 in the top wall 38, in which a spherical bearing 51 is located that rotationally supports an armature shaft 52 of a motor 60 along an axis that is parallel to the longitudinal extent of the antenna mast 15.

The housing piece 30 is a generally cylindrical, cup-like, member that carries a spherical bearing 56 at an upper end, in which the armature shaft 52 is journalled. It also carries permanent motor field magnets 58 which are bounded by an iron shield 58*a* that protects the magnets 58 from exposure to extremely low temperatures which can reduce the intensity of the magnetic field they create.

The drive transmission 34 has a drive pulley 61 in the cavity 31, secured to the end of the motor shaft 52, which extends through the top wall 38 into the cavity 31. A driven pulley 62 is supported laterally to one side of the drive pulley 61, between two bearings 72, 74. The bearing 72 is secured in the housing piece 26 and the bearing 74 in the housing piece 28, each adjacent a respective boss 36, 40, mounting the pulley 62 in axial alignment with the central openings 42, 44 that together form a through passage.

The driven pulley 62 is of a two piece construction. A hub portion 64 (FIGS. 3 and 7) has top and bottom flanges 66*a*, 66*b* that rotatably support a sleeve 68 having gear teeth about its periphery. The hub 64 has a central through passage with internal threads 70 that engage the threads of the cord 46 and acts as a rotary nut to drive the cord. A timing belt 78 driven by the pulley 61 engages the teeth on the sleeve 68 which rotates the hub 64 through an overrunning clutch 84. The clutch 84 is interposed between the sleeve 68 and hub 64 so that rotation from the sleeve to the hub is transmitted through the clutch 84.

The threaded relationship of the hub 64 and the cord 46 results in the longitudinal movement of the cord 46 upon rotation of the hub 64, which is restrained from axial movement by the bearings 72, 74. Thus, rotation of the hub through the transmission 34 drives the cord in a direction to extend the antenna sections or retract them, depending upon the direction of motor rotation. Because the pulley 61 is substantially smaller in diameter than the pulley 62, a speed reduction and power increase result.

Figure 7:
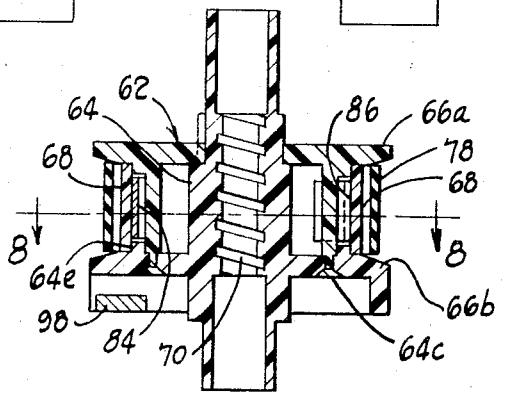
FIG. 7 is a partial sectional view of an antenna drive showing details of the construction of that drive.

As best shown in FIG. 7, the flange 66*b* is integral with the hub 64. The flange 66*a* is keyed to the hub and secured to the flange 66*b* by extensions 66*c* that extend into holes in the flange 66*b* and are heat welded in place.

The clutch 84 automatically decreases the force by which the hub and sleeve are interengaged when the antenna reaches the end of its travel during extension or retraction. The clutch overruns smoothly and without generation of excessive heat. This is accomplished by the use of a spring strip wrapped in a ring-like shape within an inside cylindrical surface 86 of the sleeve 68. The resilience of the spring strip causes it to engage the inside cylindrical surface 86 with sufficient force to frictionally rotate with the driven pulley under the loads experienced during extending and retracting the antenna sections when the sections are not obstructed.

Figure 8:
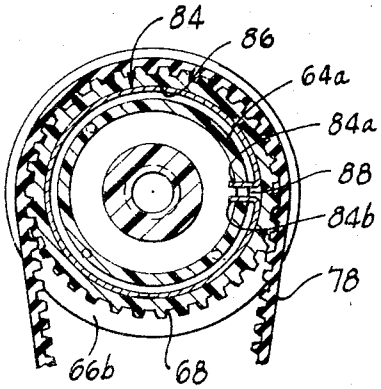
FIG. 8 is a sectional view taken along the line 8—8 of FIG. 7.

The spring strip encircles the hub 64 and has an inturned flange at 84*a*, 84*b* at each opposite end, received in a notch 88 in the hub 64. The notch is sufficiently large circumferentially to allow some peripheral movement of the ends of the spring, which are spaced from each other peripherally a short distance, as best illustrated in FIG. 8. As illustrated in FIGS. 7 and 8, the spring surrounds the outside diameter of the adjacent nut portion with radial clearance. Rotation of the sleeve, transmitted to the spring through friction, causes rotation of the hub by contact of one of the flanges 84*a*, 84*b* of the spring with an end of the receiving notch 88.

When rotation of the hub is stopped, as at the end of antenna travel, the frictional force of the sleeve 68 on the spring causes the spring to rotate slightly. This moves a free end of the spring toward the opposite end, reducing the diameter of the spring and relieving the frictional force against the inside diameter of the sleeve. This allows the sleeve to be rotated more freely by reduction of the frictional force between the spring and pulley, and thereby reduces the load on the motor and the generation of heat through the relative sliding. As will be apparent from FIG. 8, the spring functions identically in either direction of rotation of the driven pulley.

As shown in FIG. 3, the upper boss 36 receives the supporting tube 14 in closely surrounding relation. The mast is secured to and supported by the insulator 45, which compresses the O-ring seal 53. During installation of the antenna, the mast 15 and attached cord 46 is inserted into the tube 14 so the cord 46 can be inserted into the opening in the hub 64. When the mast 15 is inserted, the insulator 45 is oriented so its drains 45*a*, 45*b* communicate with the passageways 49 (FIG. 9) which, in a preferred embodiment, leads away from the threads on the cord 46 to the exterior of the housing 26. The motor 60 is energized in a direction to draw the cord 46 into the hub 64 until the mast approaches the position shown in FIG. 3, i.e. where the retaining nut 67 screwed to the outer mast section 16*e* begins to seat in the recess 69 in the top insulator 63 (FIG. 6). At this time a bottom end of the insulator 45 begins to compress or at least contact the O-ring seal 53.

The mast 15 is inserted a slight distance further until the collar 67 completely seats in the recess 69, with the flange 67*d* abutting the end of the insulator 63. This additional movement is accomplished by compressing the O-ring seal between the insulator 45 and a restricted region 71 of the housing member 26 through which the hub portion of the driven pulley 62 fits. Once the mast is properly seated in place, threaded connectors 73 with pointed ends are screwed through the tube 14 and boss 36, into the insulator 45 securely positioning the mast 15 in place. In a preferred embodiment three connectors 73 are used. In the event of damage to the core sections 16*a–d* those sections may be replaced as outlined above without removing the outermost section 16*e* which is fastened to the insulator 45.

The storage tube 22 for housing the cord 46 fits inside the boss 40. The tube has a shoulder 82 on the end to retain it within the housing. The storage tube 22, being flexible, can be bent to whatever contour desired, depending upon the wheel well shape and construction in which the assembly is mounted, to provide an enclosure for the cord 46 when the antenna mast is collapsed. Alternatively, it can be preformed to a desired contour.

Figure 4:
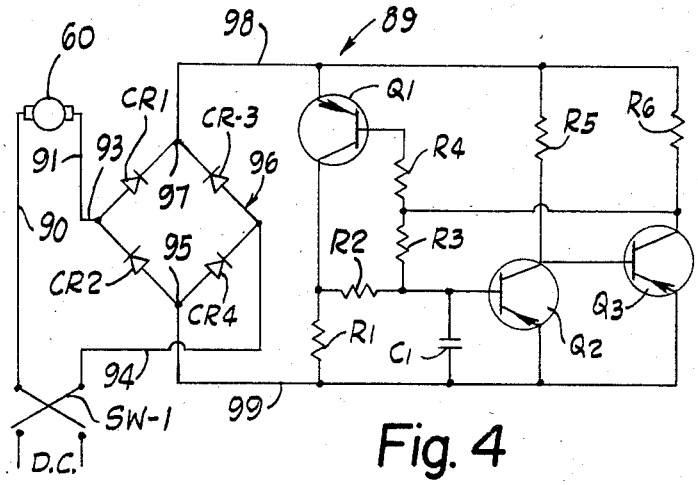
FIG. 4 is a schematic diagram of a control circuit for operating the motor of the antenna shown in FIGS. 1-3.

A schematic wiring diagram of the switch assembly 32 located within the housing piece 28 is shown in FIG. 4. As shown, power from a battery such as an automobile battery is supplied to the DC motor 60 through lines 90, 91. The direction of the motor is controlled by the polarity of the current applied through the leads, which can be changed through a double pole, double throw, center off toggle switch SW1 mounted to an automobile dashboard.

A switching circuit 89 is interposed in the lead 91 by two connecting leads 93, 94. Both leads 93, 94 connect to a rectifying bridge type circuit 96 from which two lines 98, 99 of the switching circuit are connected. The bridge circuit 96 maintains a first junction 95 negative and a second junction 97 positive regardless of the polarity of the switch SW1 to allow the switching circuit to operate regardless of a change of polarity at the connections 93, 94 when current to the motor 60 is reversed.

The switch circuit 89 removes the power from the motor when a preset time and current load conditions have been met, such as a short time after the motor reaches the end of its travel and a greatly increased load and hence current demand is placed upon the motor 60.

The circuit 89 of FIG. 4 includes diodes CR1, CR2, CR3 and CR4, three transistor Q1, Q2 and Q3, a capacitor C1 and resistors R1=1k, R2=10k, R3=10k, R4=10k, R5=1k and R6=1 ohm, all connected as shown to conduct current to the motor 60 until a predetermined current load is applied for a predetermined time.

When the switch SW1 first couples the battery to the motor 60 to drive the antenna up or down the NPN power transistor Q3 conducts in a saturated state so the car battery drives the motor 60 through the 1 ohm resistor R6. Q1 is turned off since the voltage across the one ohm resistor R6 is too small to bias that transistor into conduction. When the motor experiences a greater load as it drives the antenna to an end of travel, the current through the motor will increase causing the voltage across the resistor R6 to rise to the point where the transistor Q1 turns on. This turn on causes the capacitor C1 to charge with a R2C1 time constant until Q2 turns on. When the transistor Q2 turns on the base voltage on Q3 drops turning Q3 off. The automobile battery now drives the motor 60 through the 1k resistor R5 instead of the 1 ohm resistor R6. The current through the motor 60 drops to a point where the motor no longer rotates. This state continues until the user toggles the switch SW1 back to its center off position.

As an alternative embodiment, a magnet 98 is located in the flange **66*b* adjacent a Hall-effect transducer 99 and associated circuitry 100 that replaces the switch circuit 89. The Hall-effect switch senses rotation of the magnet 98** which rotates in excess of 20 revolutions per second when the motor is extending or retracting the antenna.

Two inputs M1, M2 to the circuit 100 (FIG. 5) are motor inputs which drive the motor in one of two directions depending upon the polarity of two inputs IP-1, IP-2 from a switch SW2. The switch SW2 is a double throw, double pole switch whose polarity is controlled by a relay (not shown) having a holding coil energized through the radio. When the coil is de-energized the switch polarity retracts the antenna and when the coil is energized the polarity is switched to extend the antenna. Thus, the antenna will extend automatically whenever the ignition and radio are both activated and will retract when either the radio or the ignition is switched off. In this embodiment the motor 60 is also energized by the car battery (not shown) so the retraction of the antenna is accomplished even though the ignition is switched off.

Assume a positive input at IP-1 which is transmitted through a diode and capacitor C2 to a base input of an NPN transistor Q-2, turning that transistor on. This in turn turns on one of the two power transistors Q-3, Q-4 to the right of FIG. 5. When IP-1 is positive it is seen that a diode between IP-1 and the emitter of Q-3 conducts so that transistor Q-2 turns on power transistor Q-3. Alternately when IP-1 is negative, capacitor C3 turns on Q-2 which turns on Q4 and the direction of current flow through the motor is reversed. Thus, whenever the transistor Q-2 conducts, one or the other of the power transistors Q-3 or Q-4 is biased into conduction by a signal at the base of that power transistor so that the application of either polarity signal at IP-1 and IP-2 energizes the motor 60.

The signal applied to IP-1 and IP-2 is a DC signal so that after the initial receipt of that signal the two capacitors C-2 and C-3 will block the transmission of those signals to the base of the transistor Q-2. Thus, but for the presence of the Hall-effect transducer 99 and a fourth transistor Q-1, the motor would receive a signal temporarily and once the blocking effect of C-2 and C-3 take effect, motor rotation would terminate.

Figure 5:
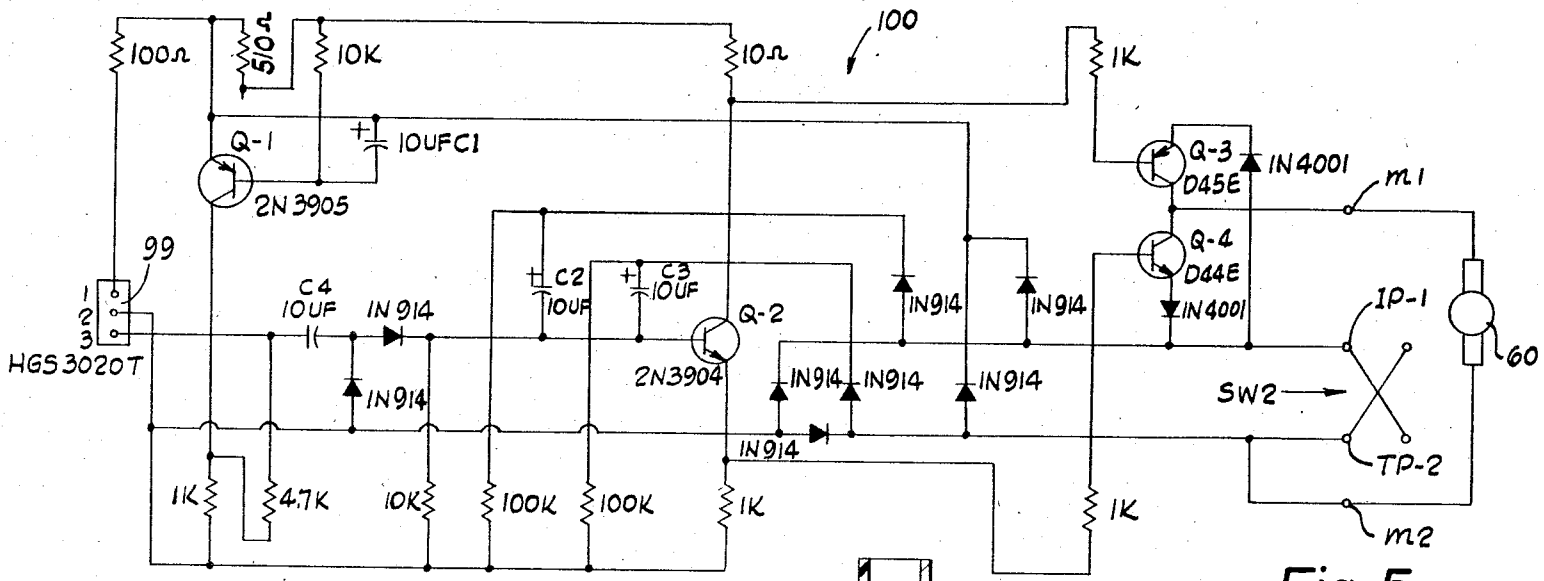
FIG. 5 is a schematic of an alternate and preferred control circuit for operating the motor.

Once rotation of the motor begins, however, the Hall-effect transducer 99 senses magnet rotation and generates pulses at its terminal labeled #3 in FIG. 5. These pulses are coupled through a capacitor C-4 and a diode to the base of the transistor Q-2. Periodic receipt of this pulse continues to bias transistor Q-2 into conduction which in turn keeps one power transistor (Q3 or Q4) turned on maintaining the motor drive signals at M-1 and M-2. In the event the motor drive action moves the antenna to one of its limits of travel, continued movement is no longer possible and the Hall transducer no longer generates these pulses. Once these pulses stop the transistor Q-2 also ceases to conduct since its base emitter junction no longer has the necessary voltage across it and for a similar reason the power transistor (either Q-3 or Q-4) also stops conducting.

A transistor Q-1 insures that the alternating pulses appearing at the base of the transistor Q-2 are generated from movement of the antenna drive and not from spurious vibrations in the car fender. The same input from either IP-1 or IP-2 which initially biases transistor Q-2 into conduction appears at the base of transistor Q-1 to cause conduction in that transistor. This transistor will continue to conduct until transistor Q-2 turns off at which time transistor Q-1 also turns off disabling the Hall-effect transducer. Thus, the Hall-effect transducer is only capable of transmitting pulses when transistor Q-1 conducts and this transistor in turn can only conduct when an input appears at either IP-1 or IP-2. Once the end of travel has been reached and the transistor Q-1 is turned off, spurious vibrations to the Hall-effect transducer will never reinitiate conduction in transistor Q-2 without the appearance of the signal at IP-1 or IP-2.

In summary, as long as the antenna is extending or retracting through hub rotation, either transistor Q-3 or Q-4 conducts; but upon reaching the end of travel or an obstruction, stopping the hub rotation, the conducting transistor turns off, automatically disrupting power to the motor drive. When the car radio is turned off, the inputs IP-1 and IP-2 are reversed to reverse current direction through the motor and the Hall-effect transducer generates pulses causing the motor to retract the antenna by driving the hub in the opposite direction until the antenna is fully retracted or movement is obstructed.

The circuit 100 (FIG. 5) is preferable to the circuit 89 (FIG. 4) since the user need not deactivate the circuit 100 after the motor 60 has fully extended or retracted the antenna. After the car ignition is turned off, IP-1 and IP-2 are still coupled to the battery by the switch SW2 but when all transistors are turned off the circuit 100 draws only about 3 milliamps, a current the battery can supply for over 3000 hours without problem.

The Hall-effect transducer can be replaced with other means for generating a pulse train to maintain the transistor Q-2 conductive. An optical sensor might be mounted in close proximity to the flange **66*b* to sense rotation of a mark or irregularity in the flange. The irregularity might comprise, for example, castellations or slots in the flange 66*b* which would preferably trigger the optical sensor. Such an optical sensor would include an infrared radiation source which would be insensitive to dirt build-up in the vicinity of the flange 66*b***.

Figure 11:
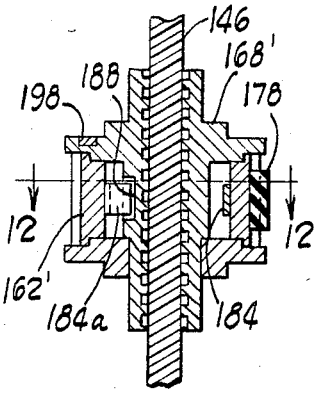
FIG. 11 is a sectional view showing the modified embodiment having a clutch engagement.
Figure 9:
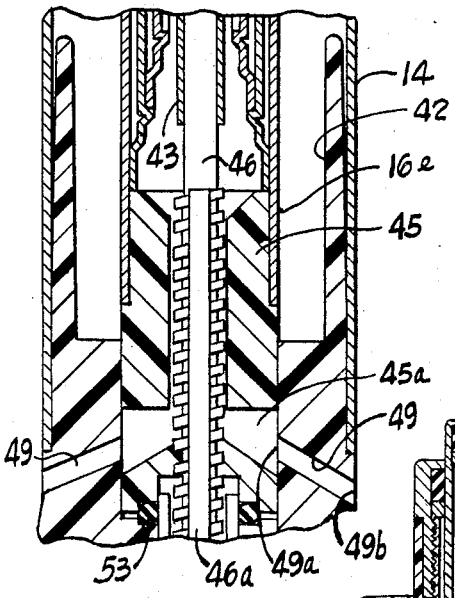
FIG. 9 is a sectional view showing a bottom of the antenna coupled to a plastic insulator sleeve which defines a passageway through which water flows away from the antenna drive to an exterior of the antenna assembly.
Figure 10:
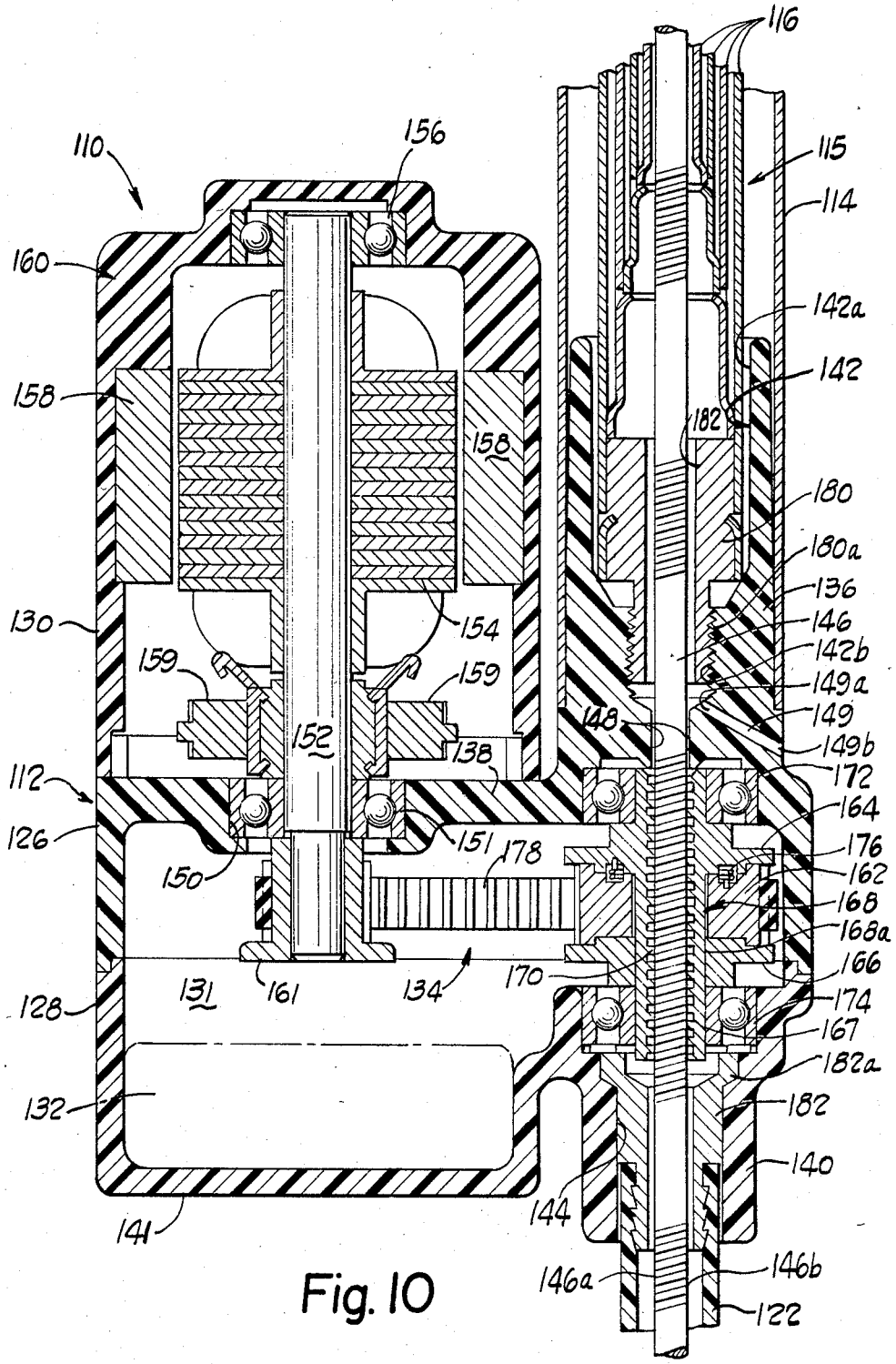
FIG. 10 is a sectional view of an alternate embodiment of the antenna.

An alternate antenna assembly 110 is shown in FIGS. 9–11. The assembly 110 includes a housing 112, supporting tube 114, antenna mast 115 and telescoping antenna sections 116. As best shown in FIG. 9, the housing 112 is formed of three injecting molded plastic pieces 126, 128, 130, that interfit to form a strong enclosure. Pieces 126, 128 together form a cavity 131 for a switch assembly 132 shown in phantom and a drive transmission 134. The housing piece 126 has a cylindrical boss 136 projecting perpendicularly from a top wall 138 to connect with a supporting tube 114. The housing piece 128 has a cylindrical boss 40 extending perpendicular to a bottom wall 141, aligned with the boss 136, and accommodating connection of a flexible storage tube 122 with the housing.

A central opening 142 extends through the boss 136 and a central opening 144 extends through the boss 140, each axially aligned with the other, to accommodate passage of a flexible cord 146 through the housing. Beyond the boss 136, the cord extends through antenna sections 116, and beyond the boss 140, it extends into the storage tube 122. The cord is of plastic, such as Delrin, and is externally threaded on two diametrically opposite portions. The cord has two diametrically opposite flat outer surfaces **146*a*, 146*b* along its length, resulting in broken threads. The flat portions are adapted to be engaged by two opposed flat surfaces 148 of the central opening 142, which prevent rotation of the cord relative to the housing. Sufficient clearance is provided between the cord and the opening 142** to allow free sliding of the cord.

To avoid risk of malfunctioning of the antenna drive from exposure to water that may find its way into the housing along or near the antenna mast, and which in cold weather can freeze and prevent relative movement between parts of the tubular drive transmission, a passage 149 is provided in the boss 136. The passage opens at one end **149*a* in communication with the central opening 142 of the boss and at the other end 149*b* at the exterior of the housing, and is inclined downwardly and outwardly. The open end 149*a* is located just above the restricting flat sides 148, opening into a wider section of the central opening 142 where water, leaking along the antenna mast, can be intercepted before reacting the drive elements and carried away through the less restrictive passage 149** to the outside of the housing.

The housing piece 126 has an opening 150 in the top wall 138, in which a bearing 151 is located that rotationally supports a shaft 152 of a motor armature 154, the axis of which is parallel to the longitudinal extent of the antenna mast 115.

The housing piece 130 is a generally cylindrical, cup-like, member that carries a bearing 156 at an upper end, in which the armature shaft 152 is journalled. It also carries permanent field magnets 158 and brushes 159, thereby forming, together with the armature, an electric motor 160 of compact dimensions.

The drive transmission 134 has a drive pulley 161 in the cavity 131, secured to the end of the motor shaft 152, which extends through the top wall 138 into the cavity 131. A driven pulley 162 is supported laterally to one side of the drive pulley 161, between two retaining flanges 164, 166 above and below the driven pulley. The upper flange 164 is part of a nut 168 with internal threads 170 that engage with the threads of the cord 146. The nut 168 has a elongated tubular body **168*a* journalled for rotation at upper and lower ends in bearings 172, 174. The bearing 172 is secured in the housing piece 126 and the bearing 174 in the housing piece 128, each adjacent a respective boss 136, 140, mounting the nut in axial alignment with the central openings 142, 144 that together form a through passage. The lower flange 166 that retains the driven pulley 162 encircles the body portion 168*a* of the nut. A spring 176 is interposed between and connected to both the driven pulley 162 and the nut 168, so that rotation from the driven pulley to the nut is transmitted through the spring 176. The spring shown is a coil spring secured to the pulley and nut by insertion of bent ends into apertures of radially opposed surfaces, but could alternatively be an energy absorbing mechanism in different form. The threaded relationship of the nut 168 and the cord 146 results in the longitudinal movement of the cord 146 upon rotation of the nut 168, which is restrained from axial movement by the bearings 172, 174. Thus, rotation of the nut through the transmission 174 drives the cord in a direction to extend the antenna sections or retract them, depending upon the direction of motor rotation. Because the pulley 161 is substantially smaller in diameter than the pulley 162, a speed reduction and power increase results. Rotation of the pulley 161 is transmitted to the pulley 162 through a timing belt 178**.

As shown in FIG. 9, the upper boss 136 receives the supporting tube 114 in closely surrounding relation. A large central passage portion **142*a* at the outer end of the boss receives the lower portion of the antenna mast 115. The mast is secured to and supported by a base connector 180 having a threaded end 180*a* received in a threaded portion 142*b* of the central opening 142. The base connector 180 has a central opening 182 through which the cord 146 extends. It will be understood that, in the normal manner, the cord 146** is secured to the upper end section of the telescoping antenna, thereby extending and retracting all all of the sections when driven relative to the housing.

The central opening 144 of the boss 140 receives a tube nipple 182 to which the tube 122 is secured. The tube extends upward into the opening 144. A shoulder **182*a* on the nipple retains it within the housing. The storage tube 122, being flexible, can be bent to whatever contour desired, depending upon the wheel well shape and construction in which the assembly is mounted, to provide an enclosure for the cord 146** when the antenna mast is collapsed.

As an alternative to the spring 176 for transmitting rotation between the driven pulley 162 and the nut 168, an overrunning clutch as shown in FIGS. 10 and 11 can be used between the two parts. The preferred construction automatically decreases the force by which the nut and driven pulley are interengaged when the antenna reaches the end of its travel during extension or retraction. Therefore, the clutch overruns smoothly and without generation of excessive heat. This is accomplished by the use of a spring strip 184 wrapped in a ring-like shape within an inside cylindrical surface 186 of the driven pulley 162'. The resilience of the spring strip causes it to engage the inside cylindrical surface 186 with sufficient force to frictionally rotate with the driven pulley under the loads experienced during extending and retracting the antenna sections when the sections are not obstructed. The spring strip encircles the nut 168' and has an inturned flange at 184*a*, 184*b* at each opposite end, received in a common notch 88 in the nut. The notch is sufficiently large circumferentially to allow some peripheral movement of the ends of the spring, which are spaced from each other peripherally a short distance, as best illustrated in FIG. 11. As illustrated in FIGS. 10 and 11, the spring surrounds the outside diameter of the adjacent nut portion with radial clearance. Rotation of the pulley, transmitted to the spring through friction, causes rotation of the nut by contact of one of the flanges 184*a*, 184*b* of the spring with an end of the receiving notch 188. When rotation of the nut is stopped, as at the end of antenna travel, the frictional force of the pulley on the spring causes the spring to rotate slightly. This moves a free end of the spring toward the opposite end, reducing the diameter of the spring and relieving the frictional force against the inside diameter of the driven pulley. This allows the driven pulley to be rotated more freely by reduction of the frictional force between the spring and pulley, and thereby reduces the load on the motor and the generation of heat through the relative sliding. As will be apparent from FIG. 11., the spring functions identically in either direction of rotation of the driven pulley.

Figure 13:
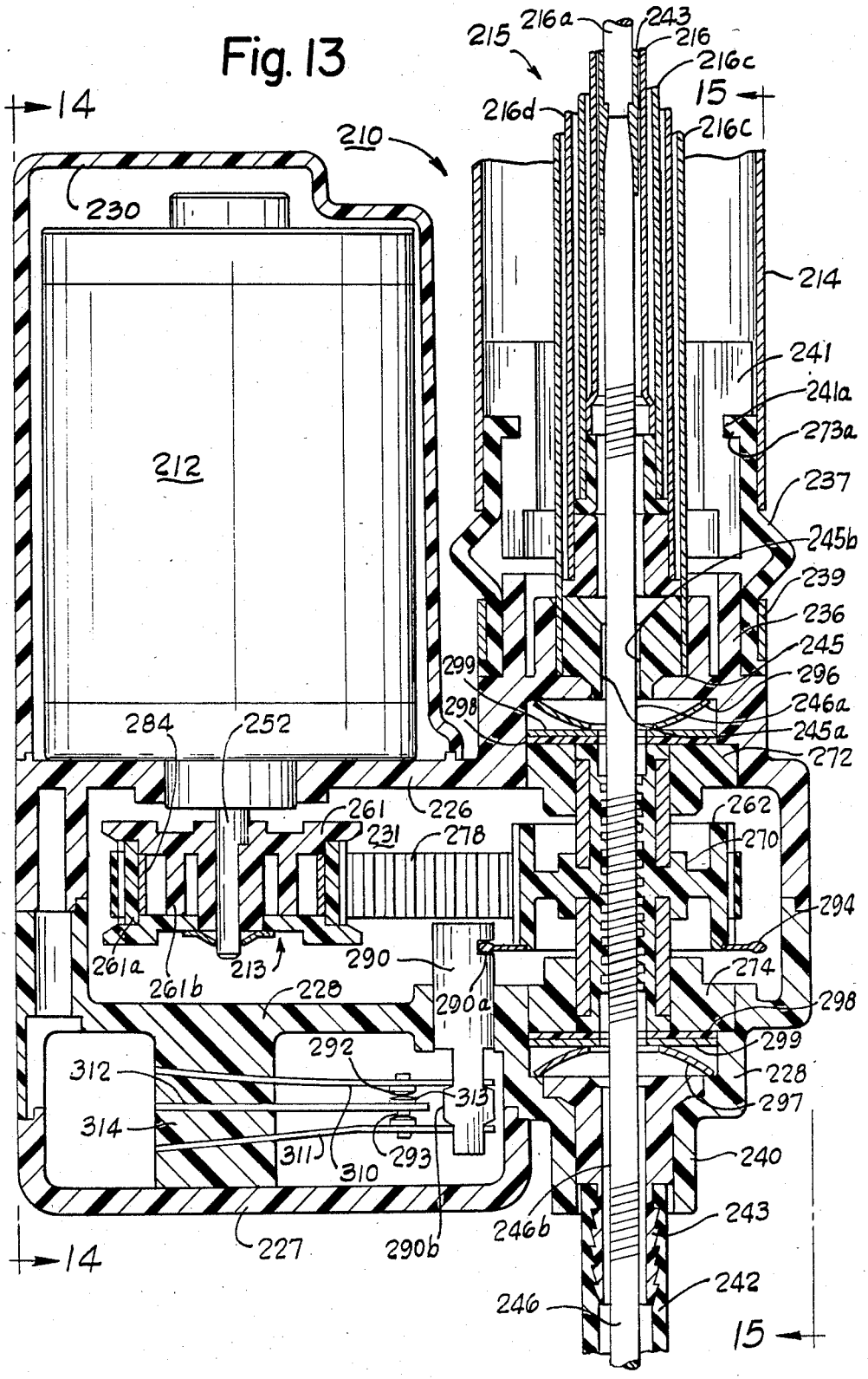
FIG. 13 is a sectional view of an alternate and preferred embodiment of the antenna.
Figure 14:
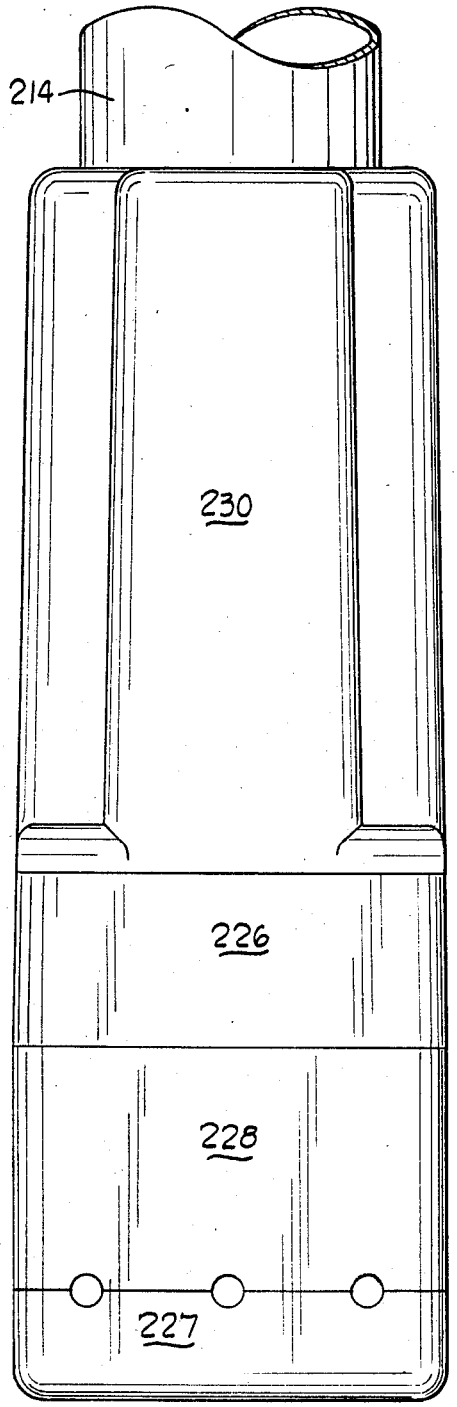
FIGS. 14 and 15 are end elevational views of the FIG. 13 embodiment of the antenna.
Figure 15:
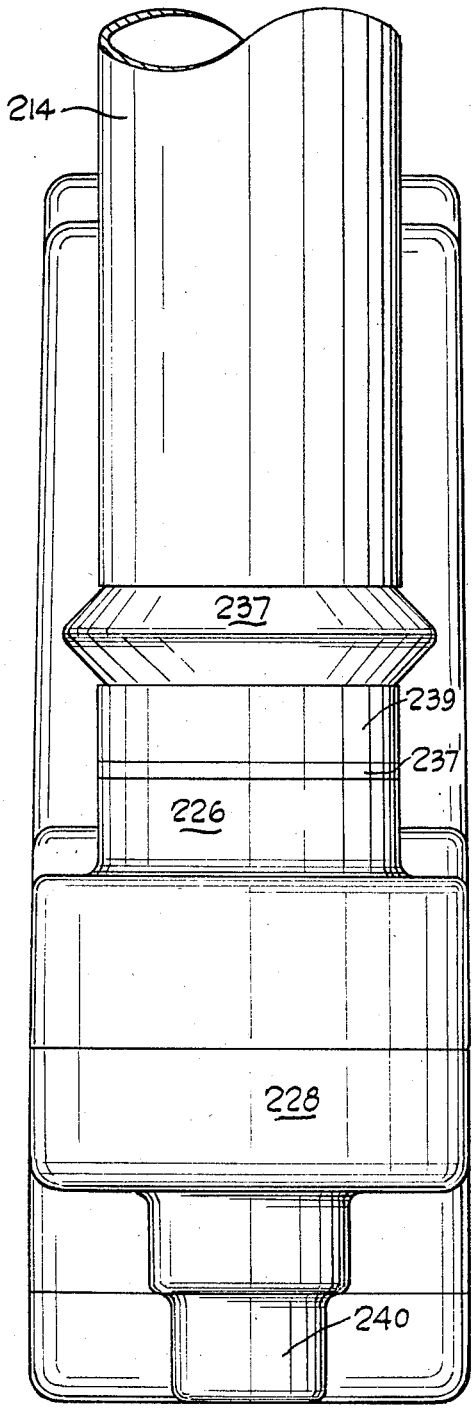

An alternate and preferred antenna assembly 210 embodying the invention is shown in FIGS. 13–15. This embodiment comprises a housing for a motor 212 and a drive transmission 213, and a supporting tube 214 for supporting the assembly and housing a collapsible antenna mast 215 comprised of telescoping sections 216*a–e*. The housing is elongated and very little wider than the supporting tube 214. The assembly 210 is very compact and can be mounted within a small space.

As best shown in FIG. 13, the housing is formed of four injection molded plastic pieces 226, 227, 228, 230, that interfit to form a strong enclosure. Pieces 226, 228 together form a cavity 231 for the drive transmission 213. The pieces 230, 226 interfit to form a cavity for the motor 212. The housing piece 226 has a cylindrical boss 236 projecting perpendicularly from a top wall coupled to the supporting tube 214 through a neoprene rubber coupling 237. The neoprene coupling 237 connects the housing to the tube 214 and isolates the housing from vibration orginating from the mounting surface 55 (FIG. 6) due to road vibration. The coupling 237 is secured to the housing 212 with a metal band 239 and threaded connectors (not shown). The connectors are screwed through holes in the band 239 into the coupling 237, boss 236, a stationary antenna section 216*e*, and finally a plastic insulator 245.

A split sleeve plastic coupling adapter 241 is secured to the support tube 214 by threaded connectors (not shown) screwed through the tube 214 into the adapter 241. A coupling lip 237*a* engages a slot 241*a* in the adapter to complete the housing support arrangement. The principal support connection between the tube 214 and the housing 212 is through the neoprene rubber vibration isolating coupling 237.

The housing piece 228 has a cylindrical boss 240 extending perpendicular to a bottom wall aligned with the boss 236, and accommodating connection of a flexible storage tube 242 with the housing via a nipple connector 243.

Central openings extend through the bosses 236, 240, each axially aligned with the other, to accommodate passage of a flexible cord 246 through the housing. Beyond the boss 236, the cord is connected to a center antenna section by a coupling tube 243 crimped around the cord 246 and center antenna section 216*a*. Beyond the boss 240, the cord 246 extends into the storage tube 242.

The cord 246 is of plastic, such as Delrin, and is externally threaded on two diametrically opposite portions. The cord has two diametrically opposite flat outer surfaces 246*a*, 246*b* along its length, resulting in peripherally broken threads. The cord passes through a central opening of a tubular plastic insulator 245 within the boss 236. The insulator 245 is partially enclosed within the base of the fixed tube 16*e* and the two are positioned around an opening in the housing piece boss 236. Two opposed flat surfaces 245*a*, 245*b* of the plastic insulator 245 prevent rotation of the cord 246 relative to the housing, yet provide sufficient clearance to allow free sliding of the cord. Because the inside passage of the insulator 245 is subject to wear from the movement of the cord 246 it is made long relative to its diameter and is replaceable within the housing.

The drive transmission 213 has a drive pulley 261 secured to the end of a motor output shaft 252, which extends through a top wall into the cavity 231. A dr.iven pulley 262 is supported laterally to one side of the drive pulley 261, between two thrust bearings 272, 274. The bearing 272 is supported in the housing piece 226 and the bearing 274 supported in the housing piece 228.

The driven pulley 262 has a central through passage with internal threads 270 that engage the threads of the cord 246 and acts as a rotary nut to drive the cord. A timing belt 278 driven by the pulley 261 engages the teeth on the pulley 262.

The threaded relationship of the pulley 262 and the cord 246 results in the longitudinal movement of the cord upon rotation of the hub. Thus, rotation of the hub through the transmission 213 drives the cord in a direction to extend the antenna sections or retract them, depending upon the direction of motor rotation.

A clutch 284 is interposed between a sleeve 261*a* and a hub portion 261*b* of the drive pulley 261 so that rotation from the sleeve to the hub is transmitted through the clutch 284.

The clutch 284 automatically decreases the force by which the hub 261*a* and sleeve 261*b* are interengaged when the antenna reaches the end of its travel during extension or retraction. The clutch overruns smoothly and without generation of excessive heat. This is accomplished by the use of a spring strip wrapped in a ring-like shape within an inside cylindrical surface of the sleeve 261*a*. The resilience of the spring strip causes it to engage the inside cylindrical surface with sufficient force to frictionally rotate with the drive pulley under the loads experienced during extending and retracting the antenna sections when the sections are not obstructed. Additional details regarding the clutch 284 are depicted in FIGS. 7 and 8 where a similar clutch is seen forming an integral part of the driven pulley 62 depicted in those figures.

The FIG. 13 embodiment of the antenna assembly senses antenna travel to control the motor 212. The position of a switch actuator 290 controls the status (open or closed) of two switches 292, 293. These switches 292, 293 replace the switching circuit 89 of FIG. 4. An open connection at either contact 292, 293 de-energizes the motor 213.

The actuator position is dictated by a flange 294 connected to the driven pulley 262 that engages an actuator slot 290*a*. In the position shown in FIG. 13, both switches 292, 293 are closed and the motor responds to switch inputs which cause the antenna to be driven up and down. When the antenna reaches an end of travel, continued rotation of the driven pulley 262 stresses the cord 246 but results in no further antenna movement. Instead, wave springs 296, 297 that are biased against thrust bearing washers 298, 299 flex, allowing the driven pulley 262 and connected flange 294 to move up or down along the now stationary cord 246 as rotation continues.

As the actuator 290 moves up or down, one of two leaf springs 310, 311 having ends coupled to the actuator 290 bend. A center support leaf 312 that supports a center switch contact 313 remains relatively stationary during actuator movement. The actuator 290 defines a shoulder portion 290*b* that engages one or the other of the leafs 310, 311 during actuator movement and opens one of the switches 292, 293. A movement in the actuator of 105 thousandths of an inch produces a gap of 60 thousandths of an inch in the affected switch to open circuit the motor 212. All three leafs 310–312 are supported by a switch header 314 integrally molded in the housing piece 228. The leafs 310–312 are metalic and are connected to the motor 213 and switch SW-1 via conductors 90, 91 so that an opening of either switch deenergizes the motor.

In an embodiment of the housings 12 and 112 the length L (FIG. 1) is 2.84 inches and the height H is 3.75 inches. The width W (FIG. 2) is 1.20 inches and the diameter D of the supporting tube 14 is 0.8 inch. Thus, in these embodiment the housing width has been kept to no more than 1.5 times greater than the width of the supporting tube and the length no more than 3.6 times greater. The over all height of the housing and antenna, except for the storage tube 22, 122 with the antenna collapsed, is 12.4 inches. The weight of the preferred embodiment is 15.9 ounces, which is sufficiently light to permit mounting with top hardware (i.e., a bracket or the like at the top of the supporting tube 14 or 114) only.

In the preferred embodiment of the antenna housing 212 (FIGS. 13–15) the length is approximately 3 inches, the height is slightly less that 4 inches, the width is approximately 1.5 inches, and the diameter of the supporting tube 214 is approximately 1.125 inches. For this embodiment the assembly is also supported only by the supporting tube 214.

The small size of each housing occupies an extremely small volume within a wheel well of the vehicle, which is highly desirable to the automobile manufacturer. It will be apparent from FIG. 3 that the housing construction, the drive transmission construction and arrangement, and the use of the housing piece 30 as a part of the motor structure, all combine to provide the extreme compactness and light weight. This is contributed to by the use of a timing belt 78 and plastic pulley wheels, in lieu of a drive train of gears, which would require additional elements, supports, and weight.

While preferred embodiments of the invention have been described in detail, various modifications or alterations may be made therein without departing from the spirit and scope of the invention set forth in the appended claims.

We claim:

1. A retractable motor-driven antenna comprising a supporting tube, telescoping antenna sections collapsible within the tube, a reversible electric motor, transmission means connected between the motor and antenna sections to extend and retract the sections relative to the tube, a control switch for controlling operation of the motor, and a housing enclosing the motor, switch, and drive means and connected with the supporting tube and antenna sections, said motor located and oriented beside the tube, with an armature shaft of the motor parallel with the tube and antenna sections, said transmission means including a drive belt and first and second speed reducing pulley wheels beneath the motor and antenna sections, the first being on the motor shaft and the second supported for rotation in the housing axially aligned with the antenna sections, an internally threaded rotary nut supported for rotation in the housing coaxially with the second pulley, means between and interconnecting the nut and second pulley wheel for permitting relative restrained rotary motion between the nut and second pulley wheel under predetermined load, a flexible cord with external thread portions extending through and threadedly engaged with said nut and connected to an antenna section, and means stationary with respect to the housing to prevent rotation of the cord.

2. An antenna as set forth in claim 1 wherein said means interconnecting the second pulley wheel and nut is a spring interposed between the two.

3. An antenna as set forth in claim 2 wherein said spring is connected to both the second pulley wheel and the nut to absorb, store and release rotary energy between the two.

4. An antenna as set forth in claim 2 wherein said spring is positively rotated with and has a lost motion connection to one of said second pulley wheel and nut and frictionally engages the other, the lost motion connection constructed and arranged to reduce said frictional engagement when one of said second pulley wheel and nut rotates relative to the other.

5. An antenna as set forth in claim 1 wherein said means interconnecting the second pulley wheel and nut is an overrunning friction clutch.

6. An antenna as set forth in claim 1, 2, 3, 4, or 5 wherein said housing is comprised of first, second and third injection molded plastic pieces, the first and second pieces together forming a chamber in which the drive mechanism is housed, the first piece having a cylindrical boss extending parallel to the motor armature and encircled by one end of the supporting tube, and the third piece forming a housing that in part directly supports the motor armature and supports motor field poles, said first and second pieces being generally elongated in the direction between the motor axis and antenna sections and narrow in the transverse direction, the width in said transverse direction being no greater than that of said third piece in said transverse direction.

7. An antenna as set forth in claim 6 wherein the said width of said first and second pieces is no more than 50% greater and the length is no more than 3.6 times greater from the diameter of said support tube.

8. An antenna as set forth in claim 7 wherein the first and second pieces each separately journal a portion of the nut for rotation and provide a passage opening through both pieces to accommodate travel of the cord.

9. An antenna as set forth in claim 1, 2, 3, 4, or 5 wherein said housing has a through passage axially aligned with the support tube through which the cord passes.

10. An antenna as set forth in claim 9 wherein said housing has a transverse passage from said through passage adjacent said drive transmission to the exterior of the housing.

11. An antenna as set forth in claim 1, 2, 3, 4, or 5 wherein said control switch is bipolar, solid state, and constructed and arranged to remove power from the motor under the application of predetermined current and time conditions.

12. An antenna as set forth in claims 1, 2, 3, 4 or 5 including means to detect movement of said transmission and for disabling said motor when said movement stops.

13. An antenna as set forth in claim 1, 2, 3, 4 or 5 wherein said nut carries a magnet and said control switch is a Hall-effect switch that is momentarily enabled upon receiving a signal voltage and remains enabled only as long as the nut is rotated above a predetermined rotational speed.

14. A motor-driven antenna comprising a supporting tube, telescoping antenna sections collapsible within the tube, a reversible electric motor, a transmission coupled to the motor including an internally threaded rotary nut supported for rotation relative to said tube, means for rotating said nut, and a flexible cord connected to an antenna section and having threaded portions extending through and threadedly engaging said nut so that rotation of said nut by the motor, which when energized extends or retracts said cord and said antenna sections relative to the tube, a housing enclosing the motor and transmission, means stationary with respect to the housing to prevent rotation of the cord as said cord is driven by said nut, and means for sensing rotation of said nut and for disabling said motor once said rotation stops, said means including a transducer mounted in close proximity to said nut for generating a sequence of pulses in response to rotation of said nut and a switch circuit responsive to said transducer for terminating energization of said reversible electric motor in response to a cessation of said sequence.

15. The antenna of claim 14 wherein said transducer comprises a Hall-effect transducer and said switch circuit comprises a switching transistor, rendered conductive by said sequence of pulses and having an output coupled to first and second power transistors for rendering one or the other of said power transistors conductive to energize said motor and either extend or retract said antenna sections.

16. A retractable motor-driven antenna comprising a supporting tube, telescoping antenna sections collapsible within the tube, a reversible electric motor, transmission means connected between the motor and antenna sections to extend and retract the sections relative to the tube, a control switch for controlling operation of the motor, and a housing enclosing the motor, switch, and drive means and connected with the supporting tube and antenna sections, said motor located and oriented beside the tube, with an output shaft of the motor parallel with the tube and antenna sections, said transmission means including a drive belt and first and second speed reducing pulley wheels beneath the motor and antenna sections, the first being on the motor shaft and the second supported for rotation in the housing axially aligned with the antenna sections, an internally threaded rotary nut supported for rotation in the housing coaxially with the second pulley, means interconnecting the motor shaft and first pulley wheel for permitting relative restrained rotary motion of the shaft relative the first pulley wheel under predetermined load, a flexible cord with external thread portions extending through and threadedly engaged with said nut and connected to an antenna section, and means stationary with respect to the housing to prevent rotation of the cord.

17. An antenna as set forth in claim 16 wherein said means interconnecting the first pulley wheel and motor shaft is a spring strip clutch interposed between the two.

18. The antenna set forth in claims 16 or 17 where the housing is comprised of multiple injection molded plastic pieces, a first and a second of said pieces forming a chamber in which the drive mechanism is housed, the first piece having a cylindrical boss extending parallel to the motor output shaft and coaxial with one end of the support tube.

19. The antenna set forth in claims 16 or 17 where the support tube is connected to the housing by a rubber coupling to isolate the housing from vibration transmitted along the support tube.

20. A motor-driven antenna comprising a supporting tube, telescoping antenna sections collapsible within the tube, a reversible electric motor, a transmission coupled to the motor including an internally threaded rotary nut, a bearing supporting the nut for rotation relative to said tube, means for rotating said nut, and a flexible cord connected to an antenna section and having threaded portions extending through and threadedly engaging said nut so that rotation of said nut by the motor, which when energized extends or retracts said cord and said antenna sections relative to the tube, a housing enclosing the motor and transmission, means stationary with respect to the housing to prevent rotation of the cord as said cord is driven by said nut, means for flexibly mounting the bearing within the housing for limited movement parallel to an axis of nut rotation, and sensing means for sensing when the nut has driven the antenna sections to a travel limit by sensing a cessation of flexible cord movement, said sensing means including an actuator coupled to the nut to sense motion of the nut as continued nut rotation threads the nut along the cord, and switching means response to the sensing means for deactivating the electric motor.

21. The antenna of claim 20 where the nut includes a flanged portion extending radially outward from an axis of nut rotation and the actuator includes a cam member that engages the flange and follows movement of the flange as the nut threads along the cord.

22. The antenna of claim 21 where the switching means comprises two switch contacts mounted to flexible supports connected to the actuator so that one or the other contact opens in response to movement of the actuator.

23. A retractable motor-driven antenna comprising a supporting tube, telescoping antenna sections collapsible within the tube, a reversible electric motor, transmission means connected between the motor and antenna sections to extend and retract the sections relative to the tube, a control switch for controlling operation of the motor, and a housing enclosing the motor, switch, and drive means and connected with the supporting tube and antenna sections, said motor located and oriented beside the tube, with an output shaft of the motor parallel with the tube and antenna sections, said transmission means including a drive belt and first and second pulley wheels beneath the motor and antenna sections, an internally threaded rotary nut supported for rotation in the housing coaxially with the second pulley, means interconnecting the motor shaft and rotary nut for permitting relative restrained rotary motion of the motor shaft relative the rotary nut under predetermined load, a flexible cord with external thread portions extending through and threadedly engaged with said nut and connected to an antenna section, and means stationary with respect to the housing to prevent rotation of the cord.

* * * * *